US010704177B2

(12) United States Patent
Mora

(10) Patent No.: US 10,704,177 B2
(45) Date of Patent: Jul. 7, 2020

(54) WASHING MACHINE LID ATTACHMENT

(71) Applicant: Haier US Appliance Solutions, Inc., Wilmington, DE (US)

(72) Inventor: Adam Raymond Mora, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 600 days.

(21) Appl. No.: 15/267,169

(22) Filed: Sep. 16, 2016

(65) Prior Publication Data

US 2018/0080160 A1 Mar. 22, 2018

(51) Int. Cl.

| | |
|---|---|
| ***D06F 37/18*** | (2006.01) |
| ***E05D 7/12*** | (2006.01) |
| ***D06F 39/14*** | (2006.01) |
| ***D06F 34/28*** | (2020.01) |
| ***E05D 3/02*** | (2006.01) |
| ***E05D 9/00*** | (2006.01) |
| *E05D 5/02* | (2006.01) |
| *D06F 23/04* | (2006.01) |
| *D06F 39/12* | (2006.01) |

(52) U.S. Cl.

CPC ..... *D06F 37/18* (2013.01); *D06F 34/28* (2020.02); *D06F 39/14* (2013.01); *E05D 7/12* (2013.01); *D06F 23/04* (2013.01); *D06F 39/12* (2013.01); *E05D 3/02* (2013.01); *E05D 5/02* (2013.01); *E05D 9/005* (2013.01); *E05Y 2600/53* (2013.01); *E05Y 2900/312* (2013.01)

(58) Field of Classification Search

CPC ..... D06F 37/18; D06F 39/14; D06F 23/04; E05D 7/12; E05D 9/005; E05D 5/125; E05D 5/2005; E05D 5/145; E05D 5/02; E05D 5/0223; E05D 5/0238; E05Y 2900/312; E05Y 2600/53; Y10T 16/5357; Y10T 16/5367

USPC ..... 16/382, 383, 387

See application file for complete search history.

(56) References Cited

U.S. PATENT DOCUMENTS 3,921,254 A * 11/1975 Foster, Jr. ..... D06F 39/14 16/229
7,513,131 B2 4/2009 Kim
9,464,376 B2 * 10/2016 Kim ..... D06F 39/14
(Continued)

FOREIGN PATENT DOCUMENTS

CN 2701894 Y 5/2005
EP 1243731 A2 * 9/2002 ..... E05D 7/12
WO WO-2015151452 A1 * 10/2015 ..... D06F 39/088

*Primary Examiner* — Hiwot E Tefera
*Assistant Examiner* — Ryan A Doyle
(74) *Attorney, Agent, or Firm* — Dority & Manning, P.A.

(57) ABSTRACT

A washing machine lid and a hinge for attaching the washing machine lid. The washing machine includes a cabinet and a rotatable lid. A hinge rotatably connects the lid to a top panel or front panel of the cabinet. The hinge includes a shaft, a housing defining a cavity for receiving an end of the shaft, and a connecting member extending from the housing such that the housing and the connecting member are rotatable around the shaft. The connecting member includes one or more tabs. The lid includes a pocket, the pocket receives the hinge, the pocket defines one or more sockets for receiving the one or more tabs, and the one or more tabs are biased into engagement with the one or more sockets.

18 Claims, 7 Drawing Sheets

(56) References Cited

U.S. PATENT DOCUMENTS

| | | | | |
|---|---|---|---|---|
| 2006/0254323 | A1* | 11/2006 | Kim | D06F 39/14<br>68/235 R |
| 2009/0066207 | A1* | 3/2009 | Laible | A47B 88/427<br>312/404 |
| 2010/0043178 | A1* | 2/2010 | Reisel | F16F 1/48<br>16/86 R |
| 2011/0121694 | A1* | 5/2011 | Kim | D06F 39/14<br>312/204 |

* cited by examiner

WASHING MACHINE LID ATTACHMENT

FIELD OF THE INVENTION

The present subject matter relates generally to washing machines, and more particularly to lids and fastening mechanisms therefore.

BACKGROUND OF THE INVENTION

Washing machines typically include a cabinet with a wash tub defined therein. Further, a wash basket is commonly provided within the wash tub. Washing machine appliances commonly utilize wash and rinse fluids to clean clothing articles disposed within the wash baskets. The wash tub contains the fluids within the cabinet of the washing machine. However, it is necessary to access the wash basket, e.g., to add or remove articles. Thus, the cabinet typically includes an opening and a lid or door attached to the cabinet to selectively rotate between a closed position and an open position which provides such access to the wash basket.

Typically, the lid or door is attached to the washing machine with conventional mechanical fasteners, e.g., screws or bolts. Use of such known attachment mechanisms can cause the lid or door to be relatively time-consuming to install during assembly or to remove for repairs. However, any attachment mechanism must be suitably robust to provide a sturdy and reliable connection between the lid or door and the cabinet, e.g., during a spin cycle when vibrations may occur.

Accordingly, a washing machine with features for quickly and easily attaching the lid or door to the cabinet and/or detaching the lid or door from the cabinet would be useful.

BRIEF DESCRIPTION OF THE INVENTION

The present subject matter provides a hinge for a lid of a washing machine. Additional aspects and advantages of the invention will be set forth in part in the following description, or may be apparent from the description, or may be learned through practice of the invention.

In a first exemplary embodiment, a hinge for a lid of a washing machine, the washing machine defining a lateral direction, a transverse direction, and a vertical direction, wherein the lateral, transverse, and vertical directions are mutually orthogonal, is provided. The hinge includes a shaft extending along the lateral direction, the shaft including a first end and a second end spaced from the first end along the lateral direction, a housing defining a cavity for receiving the second end of the shaft, and a connecting member extending from the housing such that the housing and the connecting member are rotatable around the shaft through a plane defined by the transverse direction and the vertical direction. The connecting member includes a first arm disposed orthogonal to the shaft and extending between the housing and a bend of the connecting member, the bend defining a length along the lateral direction, a second arm of the connecting member extending from the bend parallel to the first arm and spaced from the first arm by the length of the bend, the second arm comprising a free end distal from the bend, and one or more tabs on the second arm, wherein the second arm biases the one or more tabs into engagement with one or more sockets in the washing machine lid.

In a second exemplary embodiment, a washing machine appliance is provided. The washing machine appliance includes a cabinet defining a lateral direction, a transverse direction, and a vertical direction, the lateral, transverse, and vertical directions are mutually orthogonal, a top panel on the cabinet that defines an opening, a wash chamber within the cabinet below the opening of the top panel, a lid rotatable through a plane defined by the transverse direction and the vertical direction between a closed position to sealingly enclose the wash chamber and an open position to permit access to the wash chamber, the lid comprising a pocket, and a hinge rotatably connecting the lid to the top panel. The hinge includes a shaft extending along the lateral direction, the shaft comprising a first end connected to the top panel and a second end spaced from the first end along the lateral direction, a housing defining a cavity for receiving the second end of the shaft, a connecting member extending from the housing, such that the housing and the connecting member are rotatable around the shaft through a plane defined by the transverse direction and the vertical direction, and one or more tabs disposed on the connecting member, wherein the pocket receives the hinge, and the pocket defines one or more sockets for receiving the one or more tabs, and wherein the connecting member biases the one or more tabs into engagement with the one or more sockets.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
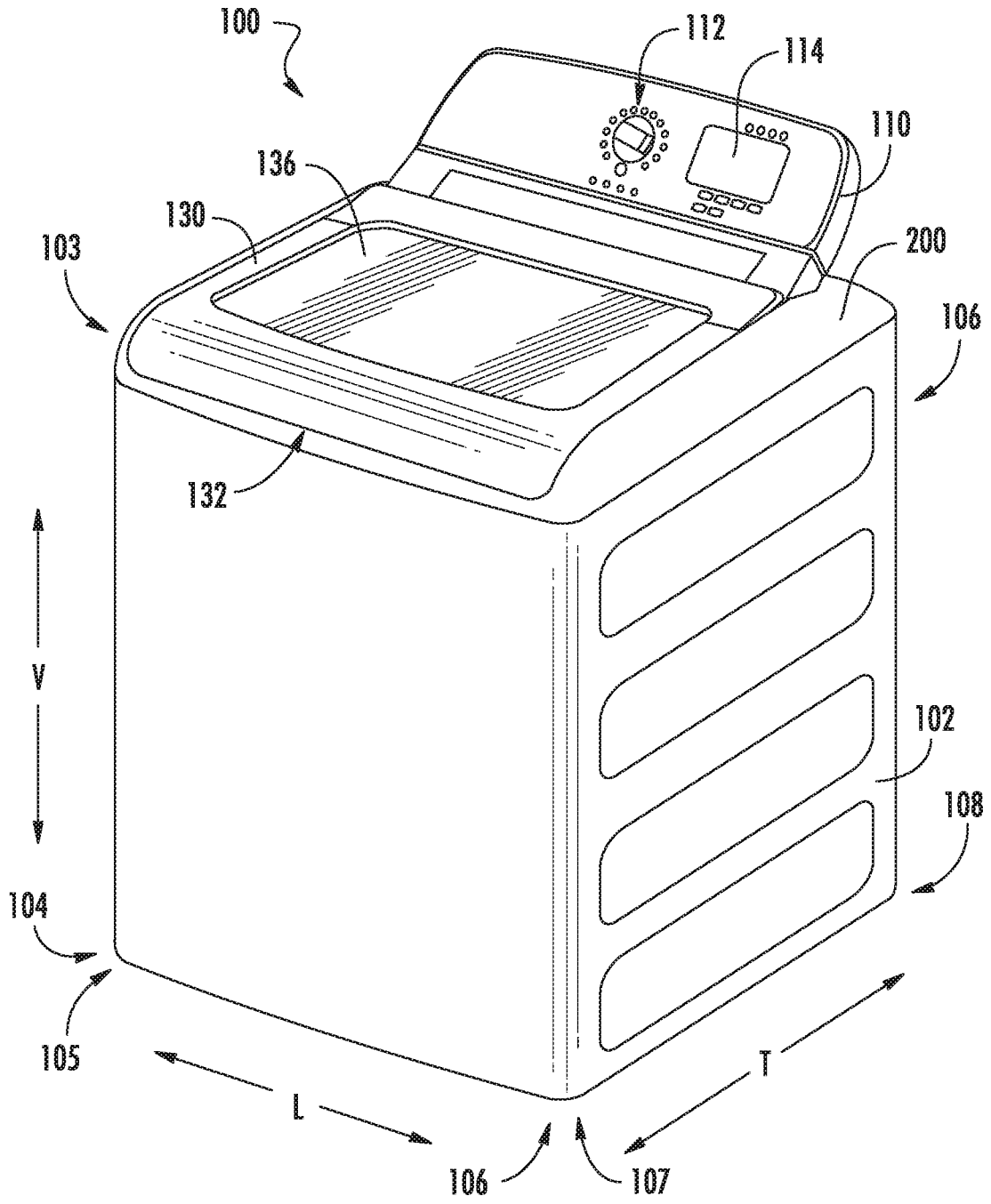
FIG. 1 provides a perspective view of a washing machine appliance according to an exemplary embodiment of the present subject matter with a lid of the exemplary washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
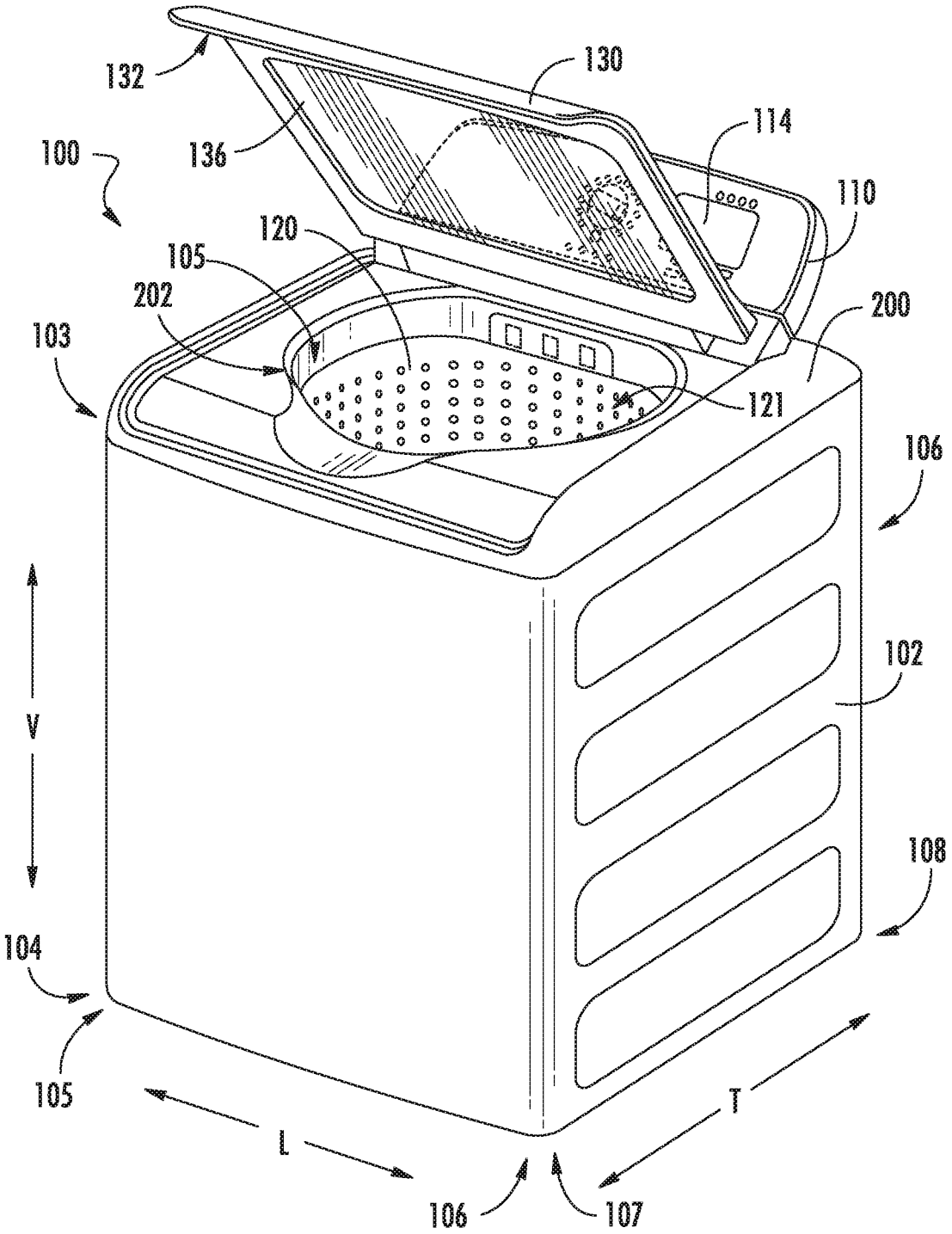
FIG. 2 provides a perspective view of the exemplary washing machine appliance of FIG. 1 with the lid shown in an open position.

FIGS. 1 and 2 illustrate an exemplary embodiment of a vertical axis washing machine appliance 100. In FIG. 1, a lid or door 130 (collectively referred to hereinafter as a "lid") is shown in a closed position. In FIG. 2, lid 130 is shown in an open position. While described in the context of a specific embodiment of vertical axis washing machine appliance 100, it will be understood that vertical axis washing machine appliance 100 is provided by way of example only. Other washing machine appliances having different configurations, different appearances, and/or different features, e.g., horizontal axis washing machines, may also be utilized with the present subject matter as well.

As may be seen in FIGS. 1 and 2, washing machine appliance 100 defines a vertical direction V, a lateral direction L and a transverse direction T. The vertical direction V, lateral direction L and transverse direction T are mutually perpendicular and form an orthogonal direction system. Washing machine appliance 100 has a cabinet 102 that extends between a top portion 103 and a bottom portion 104 along the vertical direction V. Cabinet 102 also extends between a first side portion 105 and a second side portion 106, e.g., along the lateral direction L, and a front portion 107 and a back portion 108, e.g., along the transverse direction T.

A wash basket 120 is rotatably mounted within cabinet 102, e.g., within a wash tub (not shown) disposed within cabinet 102. A motor (not shown) is in mechanical communication with wash basket 120 in order to selectively rotate wash basket 120, e.g., during an agitation or a rinse cycle of washing machine appliance 100. Wash basket 120 defines a wash chamber 121 that is configured for receipt of articles for washing. An agitator or impeller (not shown) extends from wash basket 120 into wash chamber 121. The impeller assists agitation of articles disposed within wash chamber 121 during operation of washing machine appliance 100.

In some exemplary embodiments, e.g., as illustrated in FIGS. 1 & 2, cabinet 102 of washing machine appliance 100 has a top panel 200 positioned at or adjacent top portion 103 of cabinet 102. Top panel 200 defines an opening 202 that permits user access to wash chamber 121 of wash basket 120. Lid 130 is rotatably mounted to top panel 200. However, alternatively, lid 130 may be mounted to cabinet 102 or any outer suitable support. Further alternate exemplary embodiments may include an opening defined in a front panel of washing machine 100, e.g., in exemplary embodiments wherein washing machine 100 is a horizontal axis washing machine. Lid 130 selectively rotates between the closed position shown in FIG. 1 and the open position shown in FIG. 2. In the closed position, lid 130 inhibits access to wash chamber 121. Conversely, in the open position, a user can access wash chamber 121. An aperture 136 in lid 130 permits viewing of wash chamber 121 when lid 130 is in the closed position, e.g., during operation of washing machine appliance 100. Lid 130 also includes a handle 132 that, e.g., a user may pull and/or lift when opening and closing lid 130.

A control panel 110 with a plurality of input selectors 112 extends from top panel 200 at top portion 103 of cabinet 102. Control panel 110 and input selectors 112 collectively form a user interface input for operator selection of machine cycles and features. A display 114 of control panel 110 indicates selected features, a countdown timer, and/or other items of interest to appliance users.

Operation of washing machine appliance 100 is controlled by a controller or processing device (not shown) that is operatively coupled to control panel 110 for user manipulation to select washing machine cycles and features. In response to user manipulation of control panel 110, the controller operates the various components of washing machine appliance 100 to execute selected machine cycles and features.

Suitable controllers for use in washing machine appliance 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. The processor may execute programming instructions stored in memory. The memory may be a separate component from the processor or may be included onboard within the processor. Alternatively, a suitable controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with the controller via one or more signal lines or shared communication busses.

In an illustrative embodiment, laundry items are loaded into wash chamber 121 through opening 202 (with lid 130 in the open position), and washing operation is initiated (after rotating lid 130 to the closed position) through operator manipulation of input selectors 112. Wash basket 120 or the wash tub is filled with water and detergent to form a wash fluid. One or more valves (not shown) can be controlled by washing machine appliance 100 to provide for filling wash basket 120 to the appropriate level for the amount of articles being washed. Once wash basket 120 is properly filled with fluid, the contents of wash chamber 121 are agitated (e.g., with the impeller) for cleansing of laundry items in wash basket 120.

After the agitation phase of the wash cycle is completed, wash basket 120 is drained. Laundry articles can then be rinsed by again adding fluid to wash basket 120, depending on the particulars of the cleaning cycle selected by a user, the impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. Such high-speed rotation may cause vibration and/or relative movement between lid 130 and top panel 200, as such, hinge 300 (FIG. 3) must be sufficiently robust to provide a sturdy and reliable connection between lid 130 and top panel 200. After articles disposed in wash basket 120 are cleaned and/or washed, the user can remove the articles from wash basket 120, e.g., by rotating lid 130 to the open position using handle 132 and reaching into wash chamber 121 through opening 202.

Referring now to FIGS. 3-9, embodiments of hinge 300 for use with a lid 130 of washing machine appliance 100 are shown. Hinge 300 may be connected to a corner of lid 130. For ease of illustration, only a single corner, i.e., a rear right corner (from the perspective of a user standing in front of the washing machine 100), of the lid 130 is shown. However, it is to be understood that a similar arrangement can also be provided at other locations, e.g., a mirrored version at a rear left corner of the lid 130 when the washing machine 100 is a vertical axis washing machine, or, in other exemplary embodiments, at a top corner and a bottom corner of the lid 130, e.g., in embodiments where the washing machine 100 is a horizontal-axis washing machine.

Figure 3:
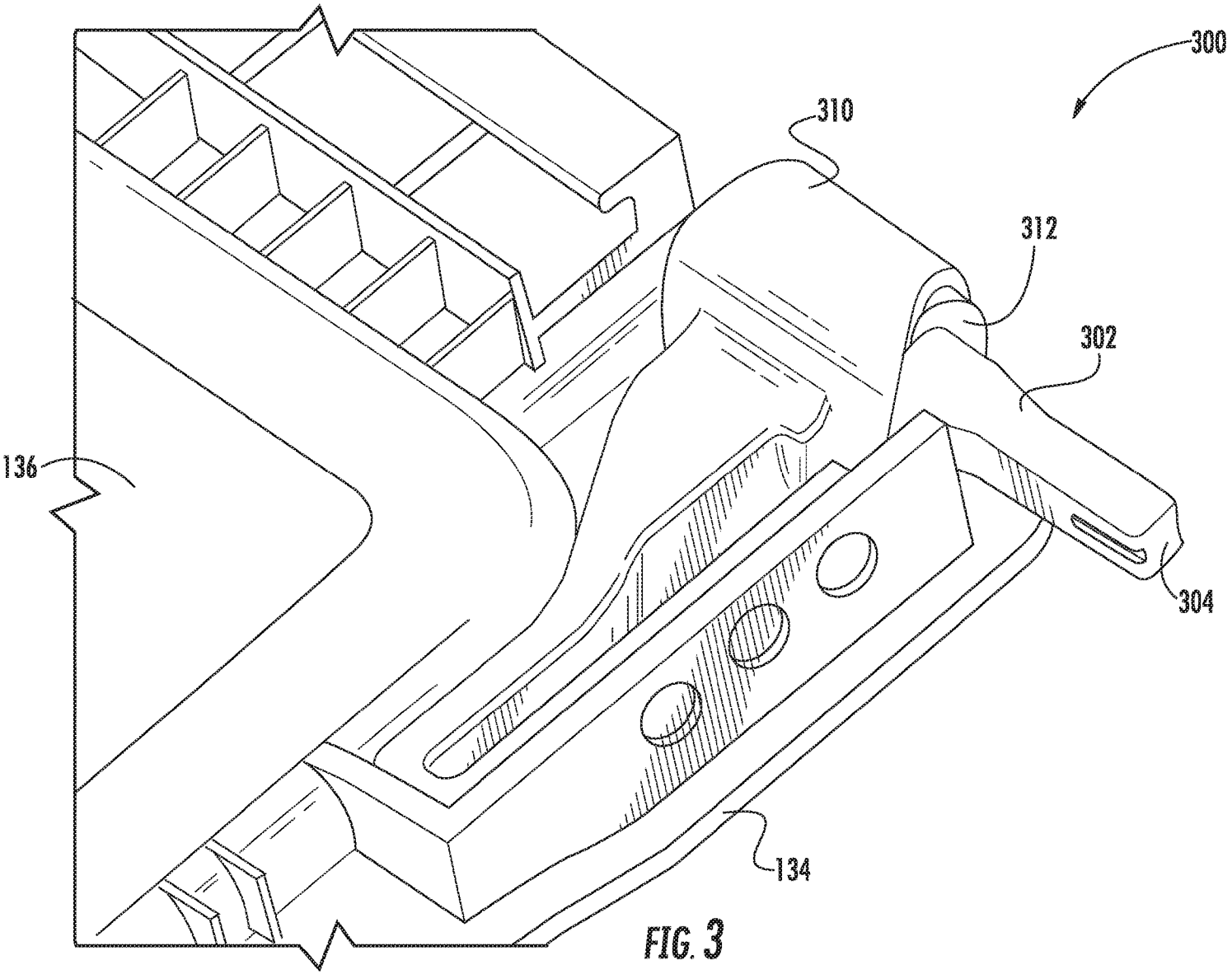
FIG. 3 provides a partial perspective view of a hinge and lid according to an exemplary embodiment of the present subject matter.
Figure 6:
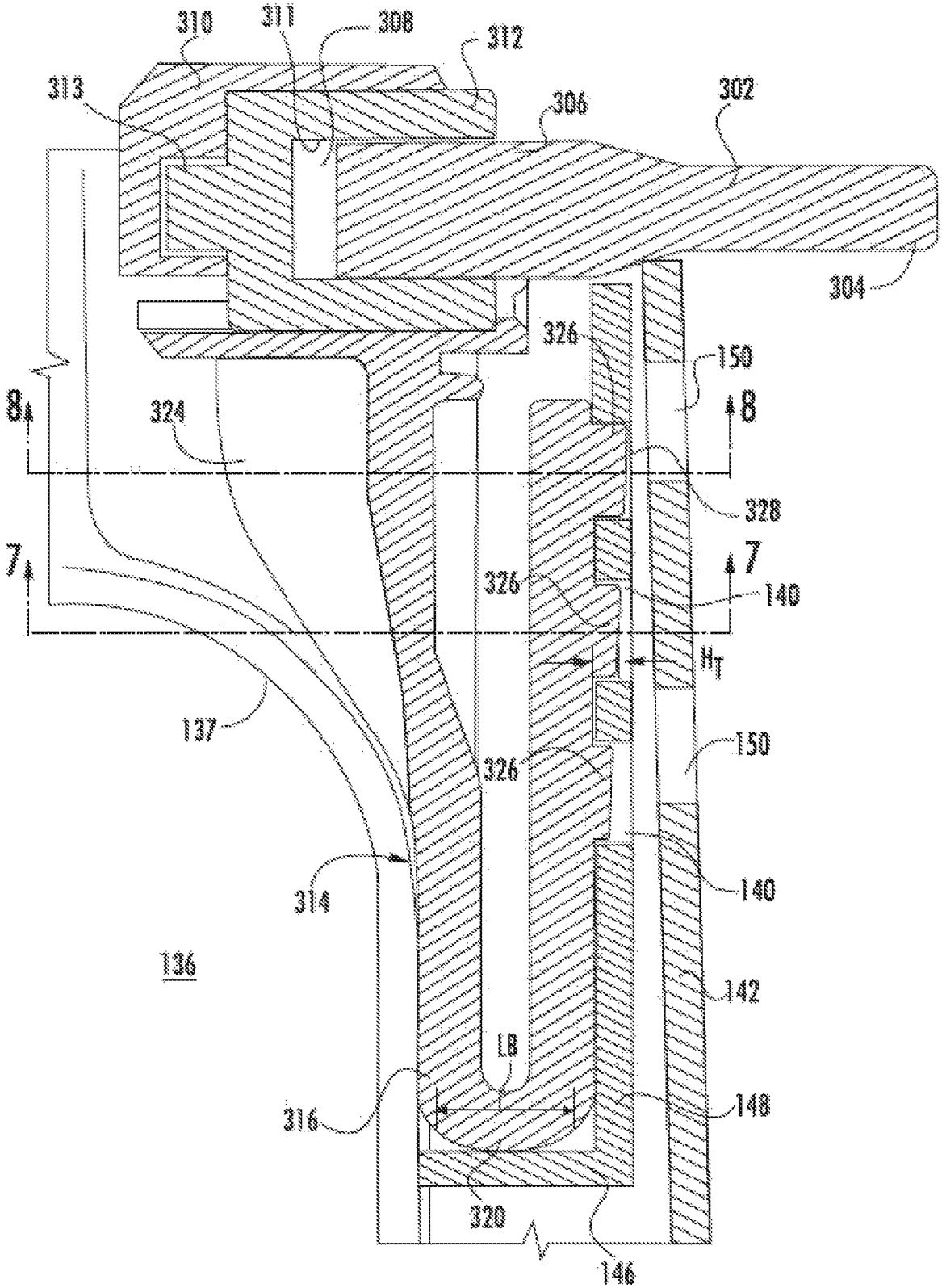
FIG. 6 provide a plan view of the hinge and lid of FIG. 5.
Figure 7:
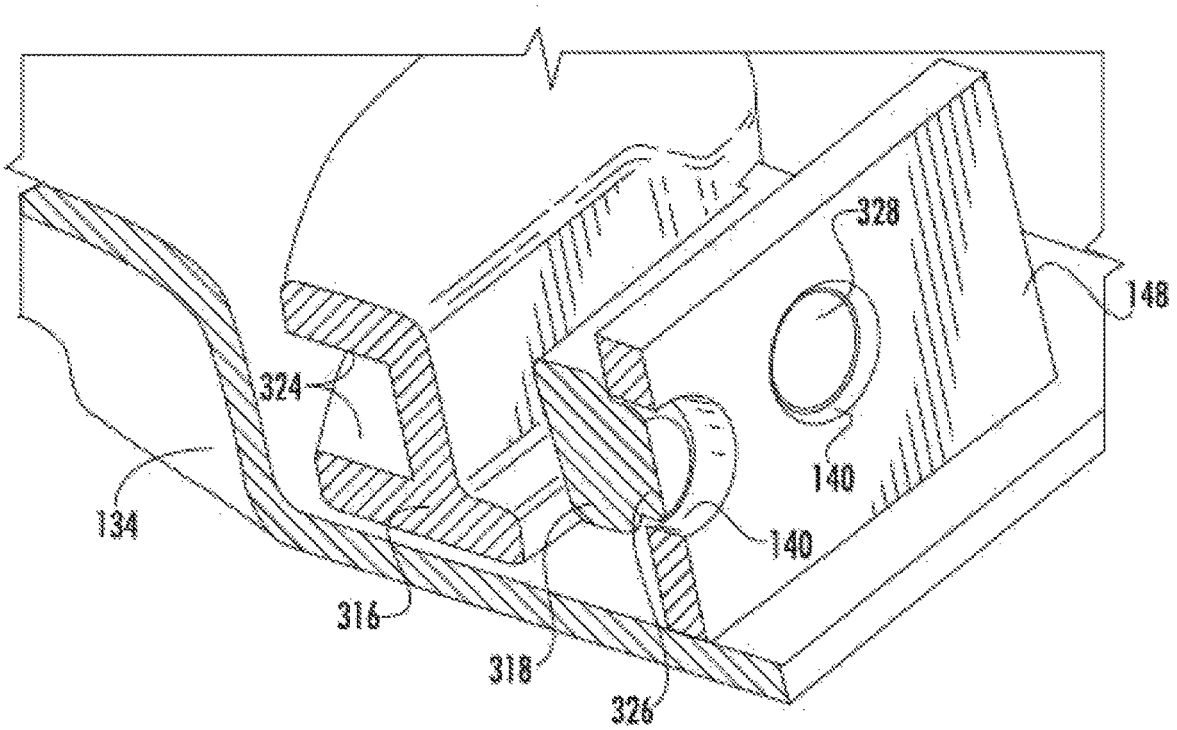
FIG. 7 provides a section view of the hinge and lid of FIG. 6, taken along line 7-7 in FIG. 6.

As may be seen in FIG. 3, in some exemplary embodiments, hinge 300 includes a shaft 302 extending along the lateral direction L. The shaft 302 extends between a first end 304 and a second end 306 (FIG. 6). As such, when installed, the second end 306 is spaced from the first end 304 along the lateral direction L. The first end 304 of the shaft 302 may be received by cabinet 102, e.g., in top panel 200 of cabinet 102. The shaft 302 may be fixed relative to cabinet 102, e.g., first end 304 may be polygonal to inhibit relative rotation between shaft 302 and cabinet 102.

Hinge 300 also includes a housing 310 defining a cavity 311 for receiving the second end 306 of the shaft 302. Second end 306 may be directly or indirectly received within cavity 311. In some exemplary embodiments, e.g., as illustrated in FIG. 6, a bearing 312 may be provided between the housing 310 and the second end 306 of the shaft 302. In other exemplary embodiments, the housing 310 may directly bear on the shaft 302, e.g., the cavity 311 may be in contact with the second end 306 of the shaft 302 with no solid material therebetween. Thus, in various embodiments, bearing 312 may be omitted, or may be integrally formed in a unitary piece with housing 310, or may be provided as a separate piece, e.g., as illustrated in FIG. 6.

The hinge 300 further includes a connecting member 314 extending from the housing 310 such that the housing 310 and the connecting member 314 are rotatable around the shaft 302 through a plane defined by the transverse direction T and the vertical direction V. As shown in the exemplary embodiment illustrated in the FIGS., second end 306 of shaft 302 may have a curvilinear, e.g., circular, cross-section to facilitate rotation. More particularly, second end 306 of shaft 302 may form a cylindrical portion of shaft 306. Housing 310 and/or bearing 312 may be correspondingly shaped to accommodate second end 306 of shaft 302. Thus, in embodiments where housing 310 bears directly on second end 306, the cavity 311 may be cylindrical as well to slidably interface with cylindrical second end 306. In embodiments wherein bearing 312 is provided as a distinct piece, bearing 312 may include a cylindrical inner surface to slidably interface with cylindrical second end 306. Further in such embodiments, bearing 312 may include features to interconnect with housing 310. For example, as illustrated in FIG. 6, bearing 312 may include a reinforcing barb 313. It would also be possible to provide bearing 312 with additional or other features for interconnecting with housing 310, e.g., bearing 312 may have a splined outer surface and cavity 311 may be correspondingly shaped to matingly receive the bearing 312 therein.

Also illustrated in the exemplary embodiment of FIG. 6, in some embodiments, a fluid reservoir 308 may be defined between the second end 306 of shaft 302 and the housing 310 and/or bearing 312. The fluid reservoir may sealingly retain a damping fluid. Providing damping fluid within reservoir 308 may impede rotation of the hinge 300 (e.g., rotation of housing 310 and connecting member 314 around shaft 302, as described above) to avoid or minimize the lid 130 slamming shut. Further, damping fluid within fluid reservoir 308 may provide a self-closing feature such that a user can simply tap or nudge the lid 130 towards the closed position and the lid 130 will slowly and gently close on its own.

The connecting member 314 provides a connection between hinge 300 and lid 130. More particularly, connecting member 314 extends from housing 310 such that it serves as a lever arm for rotating lid 130 and housing 310 about shaft 302. Further, hinge 300 is interlocked with lid 130 via engagement of one or more tabs 326 with one or more sockets 140 in the lid 130. Such engagement is provided by connecting member 300, which serves to bias the tabs 326 into engagement with the sockets 140 in the washing machine lid 130.

The connecting member 314 includes a first arm 316 disposed orthogonal to the shaft 302. First arm 316 of the connecting member 314 extends between the housing 310 and a bend 320 of the connecting member 314. Bend 320 defines a length $L_B$ along the lateral direction L. The connecting member 314 also includes a second arm 318 extending from the bend 320, parallel to the first arm 316 and spaced from the first arm 316 by the length $L_B$ of the bend 320. The second arm 318 includes a free end 322 distal from the bend and one or more tabs 326 on the second arm 318, e.g., tabs 326 extend from second arm 318 away from first arm 316. Because the free end 322 of second arm 318 is unconstrained, second arm 318 may flex towards first arm 316. Preferably connecting member 314, and in particular second arm 318, is made of a resilient material, for example spring metal or a resilient thermoplastic such as polyetherimide, such that the second arm 318 may flex towards first arm 316, e.g., when connecting member 314 is installed in pocket 144 of lid 130 (as will be further described below) and the second arm 318 may then resiliently return to its neutral position, such that the tabs 326 snap into the sockets 140 in the washing machine lid 130. As such, second arm 318 biases the one or more tabs 326 into engagement with the one or more sockets 140 in the washing machine lid 130.

Figure 4:
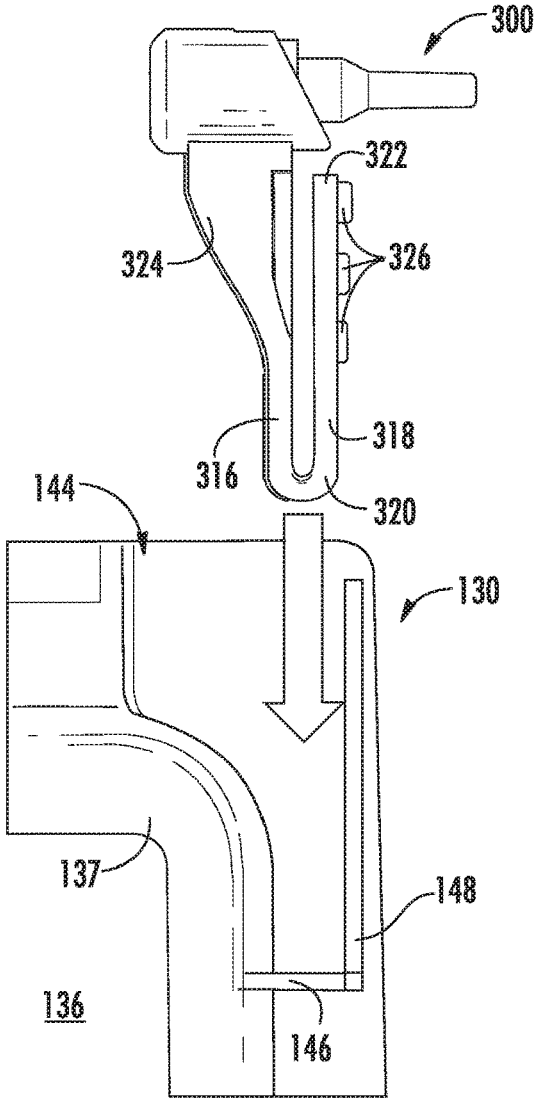
FIG. 4 provides a partial view of a hinge and lid in a detached position according to an exemplary embodiment of the present subject matter.
Figure 5:
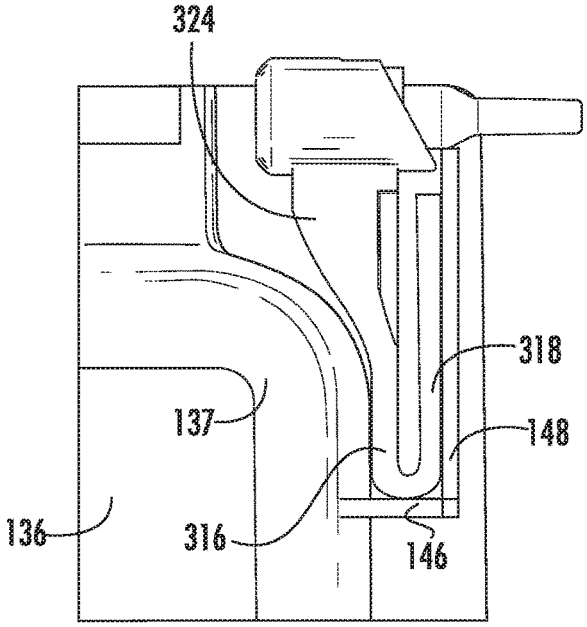
FIG. 5 provides a view of the hinge and lid of FIG. 4 in an assembled position.
Figure 8:
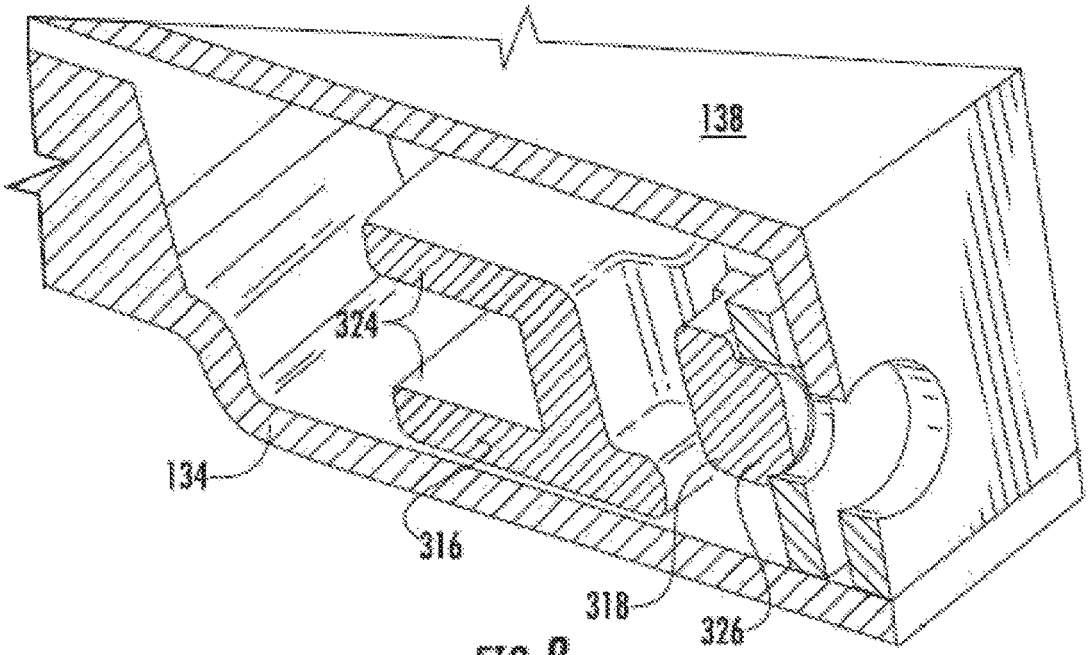
FIG. 8 provides a section view of the hinge and lid of FIG. 6, taken along line 8-8 in FIG. 6.
Figure 9:
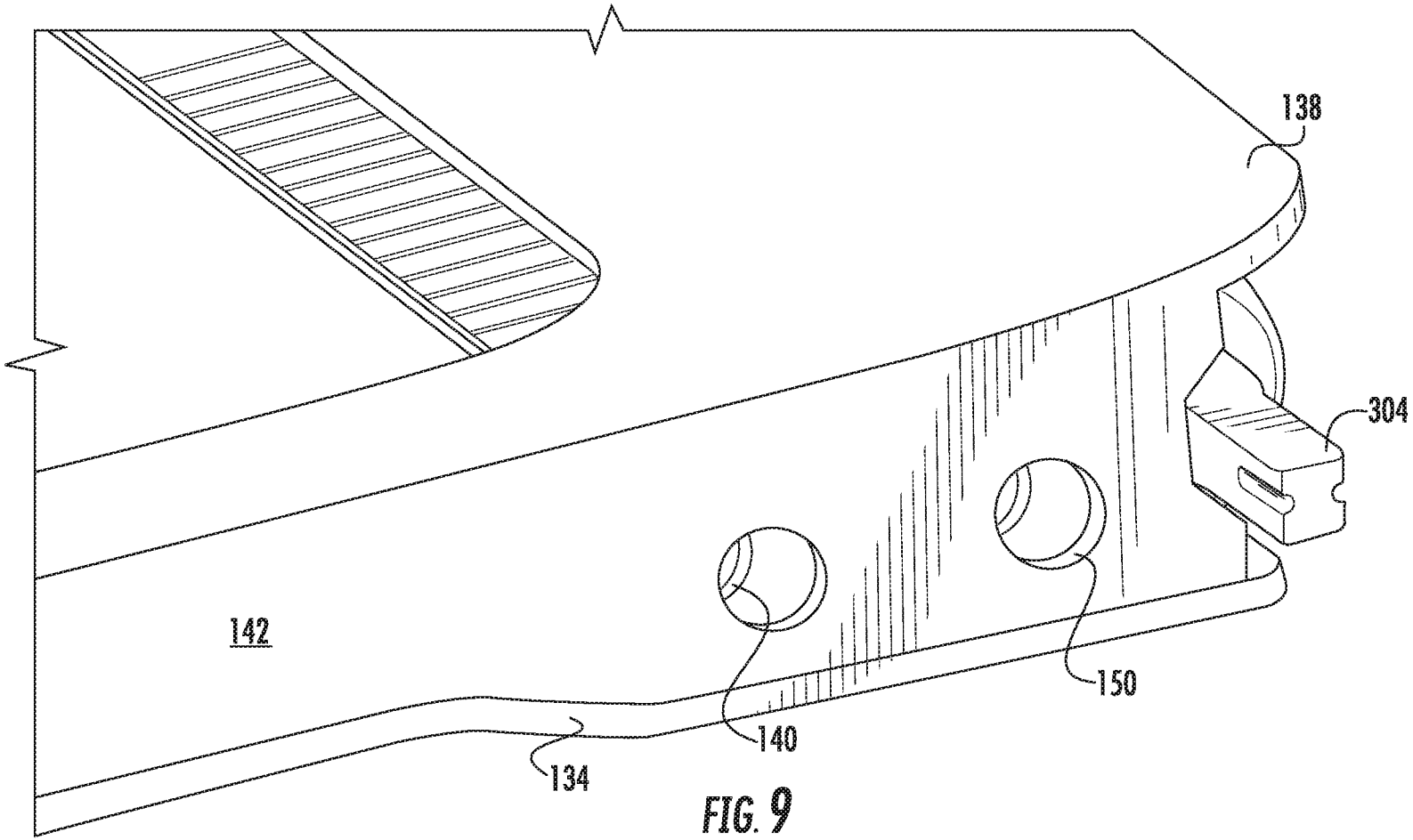
FIG. 9 provides a partial perspective view of a hinge and lid according to an exemplary embodiment of the present subject matter.

As shown in FIGS. 4 and 5, hinge 300 may be installed in lid 130 by a snap-fit connection between connecting member 314 of hinge 300 and a pocket 144 in lid 130. A rotatable connection is thereby provided such that lid 130 is rotatable through a plane defined by the transverse direction T and the vertical direction V between a closed position (FIG. 1) to sealingly enclose the wash chamber 121 and an open position (FIG. 2) to permit access to the wash chamber 121. Lid 130 includes a lower panel 134 and an upper panel 138 (FIGS. 6, 8, and 9). The pocket 144 is formed in lower panel 134 in the exemplary embodiment illustrated in the FIGS (for clarity of illustration, upper panel 138 of lid 130 is omitted from FIGS. 3-5 and 7). However, it is also possible to form the pocket 144 in other parts of lid 130, e.g., in upper panel 138 or within a unitary lid 130. In the exemplary embodiment of FIGS. 3-5, pocket 144 is defined by a corner 137 of the aperture 136, as well as a lateral wall 146 and an oblique wall 148 within the lower panel 134. Oblique wall 148 may be oblique to an outer wall 142 of the lid 130. Sockets 140 may be formed within a part of the pocket 144, e.g., as illustrated in FIG. 3, in some embodiments sockets 140 may be formed in oblique wall 148. In some embodiments, the first arm 316 of the connecting member 314 may include reinforcing wings 324 extending along the lateral direction L from the first arm 316 such that the reinforcing wings 324 engage the corner 137 of the aperture 136 when the hinge 300 is inserted into the pocket 144.

In some exemplary embodiments, the one or more tabs 326 may be a plurality of tabs 326, e.g., as illustrated in FIGS. 3-6, three tabs 326 may be provided. In some embodiments, e.g., as illustrated in FIG. 6, each tab 326 defines a height $H_T$ along the lateral direction L, and the height $H_T$ of each tab 326 decreases towards the bend 320. Each tab 326 has an outer surface 328 which may be oblique to the second arm 318 of the connector member 314. In some embodiments, such as illustrated in FIG. 6, the outer surfaces 328 of the tabs 326 may be aligned such that they are coplanar.

Thus, as shown in FIGS. 4 and 5, hinge 300 may be snapped into lid 130, and in particular pocket 144 of lid 130, by inserting connecting member 314 into pocket 144, whereupon engagement of tabs 326 with an edge of oblique wall 148 will press second arm 318 towards first arm 316. The increasing height of tabs 326 will cause second arm 318 to flex further towards first arm as connecting member is progressively inserted into pocket 144. This may prevent inadvertent partial engagement of the tabs 326 and sockets 140, e.g., in the illustrated exemplary embodiment, second arm 318 will not flex back into its neutral position to bias the tabs 326 into engagement with the sockets 140 until each of the three tabs 326 is aligned with a corresponding one of the sockets 140. Additionally, the tapered outer surfaces 328 and progressive height $H_T$ of tabs 326 reduce assembly forces. Second arm 318 is most flexible at free end 322 thereof and more rigid closer to the bend 320. Because the tabs 326 are shorter closer to the bend 320, second arm 318 flexes less where it is most rigid, thus reducing the required insertion forces for assembling hinge 300 in lid 130. Further, the tapered outer surfaces 328 and progressive height $H_T$ of tabs 326 provide a more uniform loading across the tabs 326.

A service access hole 150 may be defined in the outer wall 142 of the lid 130 to permit access to the tabs 326 to disengage the tabs 326 from the sockets 140. Using service access hole 150, an authorized repairperson may disengage hinge 300 from lid 130, permitting removal of lid 130 as may be necessary for repairs, maintenance, or replacement. Service access hole 150 may be configured to receive a specially shaped tool to prevent unauthorized removal of lid 130, e.g., service access hole 150 may be shaped to correspond to the particular shape of the tool.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A hinge for a lid of a washing machine, a cabinet of the washing machine defining a lateral direction, a transverse direction, and a vertical direction, wherein the lateral, transverse, and vertical directions are mutually orthogonal, a top panel on the cabinet that defines an opening; a wash chamber within the cabinet below the opening of the top panel; the lid rotatable through a plane defined by the transverse direction and the vertical direction between a closed position to sealingly enclose the wash chamber and an open position to permit access to the wash chamber, the lid comprising a pocket; and the hinge rotatably connecting the lid to the top panel, the hinge comprising:

a shaft extending along the lateral direction, the shaft comprising a first end configured to connect to the top panel and a second end spaced from the first end along the lateral direction;

a housing defining a cavity for receiving the second end of the shaft; and a connecting member extending from the housing such that the housing and the connecting member are rotatable around the shaft through a plane defined by the transverse direction and the vertical direction, the connecting member comprising:

a first arm disposed orthogonal to the shaft and extending between the housing and a bend of the connecting member, the bend defining a length along the lateral direction;

a second arm of the connecting member extending from the bend towards the housing parallel to the first arm and spaced from the first arm by the length of the bend, the second arm comprising a free end distal from the bend; and one or more tabs on the second arm;

wherein the pocket is configured to receive the hinge, and the pocket defines one or more sockets for receiving the one or more tabs; wherein the second arm biases the one or more tabs for engagement with the one or more sockets in the washing machine lid.

2. The hinge of claim 1, wherein the one or more tabs is a plurality of tabs.

3. The hinge of claim 2, wherein each tab defines a height along the lateral direction and the height of each tab decreases towards the bend.

4. The hinge of claim 2, wherein each tab of the plurality of tabs extends from the second arm in a direction away from the first arm to an outer surface, wherein the outer surface of each tab of the plurality of tabs is oblique to the second arm of the connector member.

5. The hinge of claim 4, wherein the outer surfaces of the tabs are coplanar.

6. The hinge of claim 1, wherein the first arm comprises reinforcing wings extending along the lateral direction.

7. The hinge of claim 1, further comprising a bearing disposed between the housing and the second end of the shaft, the bearing comprising a cavity for receiving the second end of the shaft, wherein the bearing and the second end of the shaft are received within the cavity of the housing.

8. The hinge of claim 1, further comprising a fluid reservoir defined between the second end of the shaft and the cavity, the fluid reservoir configured to sealingly retain a damping fluid.

9. A washing machine, comprising:

a cabinet defining a lateral direction, a transverse direction, and a vertical direction, the lateral, transverse, and vertical directions are mutually orthogonal;

a top panel on the cabinet that defines an opening;

a wash chamber within the cabinet below the opening of the top panel;

a lid rotatable through a plane defined by the transverse direction and the vertical direction between a closed position to sealingly enclose the wash chamber and an open position to permit access to the wash chamber, the lid comprising a pocket; and a hinge rotatably connecting the lid to the top panel, the hinge comprising:

a shaft extending along the lateral direction, the shaft comprising a first end connected to the top panel and a second end spaced from the first end along the lateral direction;

a housing defining a cavity for receiving the second end of the shaft;

a connecting member extending from the housing, such that the housing and the connecting member are rotatable around the shaft through a plane defined by the transverse direction and the vertical direction, the connecting member comprising:

a first arm disposed orthogonal to the shaft and extending between the housing and a bend of the connecting member, the bend defining a length along the lateral direction;

a second arm extending from the bend towards the housing parallel to the first arm and spaced from the first arm by the length of the bend, the second arm comprising a free end distal from the bend; and one or more tabs disposed on the second arm of connecting member;

wherein the pocket receives the hinge, and the pocket defines one or more sockets for receiving the one or more tabs, and wherein the second arm of the connecting member biases the one or more tabs into engagement with the one or more sockets.

10. The washing machine of claim 9, wherein the lid further comprises an aperture, a lower panel and an upper panel, the pocket defined by a corner of the aperture, a lateral wall and an oblique wall within the lower panel.

11. The washing machine of claim 10, wherein the oblique wall is oblique to a portion of an outer wall of the lid which extends along the transverse direction.

12. The washing machine of claim 10, wherein the one or more sockets are defined in the oblique wall.

13. The washing machine of claim 9, wherein the first arm of the connecting member comprises reinforcing wings extending along the lateral direction such that the reinforcing wings engage the corner of the aperture when the hinge is inserted into the pocket.

14. The washing machine of claim 9, wherein the one or more tabs is a plurality of tabs.

15. The washing machine of claim 14, wherein each tab of the plurality of tabs extends from the second arm in a direction away from the first arm to an outer surface, wherein the outer surface of each tab of the plurality of tabs is oblique to the second arm of the connector member.

16. The washing machine of claim 15, wherein the outer surfaces of the tabs are coplanar.

17. The washing machine of claim 9, wherein the hinge further comprises a fluid reservoir defined between the second end of the shaft and the cavity, the fluid reservoir configured to sealingly retain a damping fluid.

18. The washing machine of claim 9, further comprising a service access hole defined in an outer wall of the lid to permit access to the one or more tabs to disengage the one or more tabs from the one or more sockets.

* * * * *